United States Patent [19]

Coons, Jr. et al.

[11] Patent Number: 4,757,346

[45] Date of Patent: Jul. 12, 1988

[54] OPTICAL SYSTEM FOR SCANNING AND FLASH EXPOSING OF DOCUMENT

[75] Inventors: Robert A. Coons, Jr., Holcomb; Wayne R. Smith, Pittsford, both of N.Y.

[73] Assignee: Xerox Corporation, Stamford, Conn.

[21] Appl. No.: 590,246

[22] Filed: Mar. 16, 1984

[51] Int. Cl.[4] ..... G03G 15/04

[52] U.S. Cl. ..... 355/3 R; 355/49; 355/51; 355/65; 355/66; 355/8

[58] Field of Search ..... 355/75, 76, 47, 48, 355/49, 50, 51, 64, 65, 66, 67, 68, 69, 70, 71, 14 E, 3 R, 8

[56] References Cited

U.S. PATENT DOCUMENTS

| | | | |
|---|---|---|---|
| 3,790,270 | 2/1974 | Donohue | 355/14 |
| 3,790,271 | 2/1974 | Donohue | 355/14 |
| 3,833,296 | 9/1974 | Vola et al. | 355/51 |
| 3,963,345 | 6/1976 | Stemmle et al. | 355/50 |
| 4,027,961 | 6/1977 | Starkweather | 355/3 R |
| 4,054,380 | 10/1977 | Donohue et al. | 355/14 |
| 4,162,848 | 7/1979 | Platt | 355/14 |
| 4,309,102 | 1/1982 | Pudark et al. | 355/14 SH |
| 4,322,160 | 3/1982 | Kobus | 355/75 |
| 4,449,811 | 5/1984 | Betron et al. | 355/75 |
| 4,456,369 | 6/1984 | Sato | 355/14 SH |
| 4,497,481 | 2/1985 | Wetzel | 271/3.1 |

FOREIGN PATENT DOCUMENTS

| | | |
|---|---|---|
| 56-130769 | 10/1981 | Japan . |

*Primary Examiner*—R. L. Moses

[57] ABSTRACT

A flash exposure, full frame electrostatographic printing system is disclosed as having a document support drum and an optical arrangement for scanning a document for exposing the same to a moving photoreceptor belt. The optical arrangements for flash exposure and scanning have most of their respective parts in common. A mirror is incorporated into the optical arrangement for scanning and is movable into and out of the optical path thereof.

1 Claim, 8 Drawing Sheets

OPTICAL SYSTEM FOR SCANNING AND FLASH EXPOSING OF DOCUMENT

The present invention is directed to copying machines in general and particularly to a novel electrostatographic system arranged for scanning a document sheet positioned on a rotatable drum to produce a flowing document exposure on a photosensitive surface in the form of a belt in combination with means for producing flash exposures of documents on the belt at a common exposure zone.

Generally, copying machines which employ document supporting drums for scanning and exposing document sheets to a moving photoreceptor are of the single mode type, that is, the copier is adapted only for this type of exposure. If one needed reproductions of originals which could not be applied to a drum surface, a second copier would need to be employed for such originals. The need for a scanning drum in a copier is very advantageous when attempting to copy large documents, say on the order of 11 inches by 17 inches, or in the event two regular size documents are to be copied on one side of a single copy sheet at one to one, or size for size magnification. For duplex copying, by having originals for both sides of a copy sheet on a scanning drum, many copy sheets may be produced of the two sides at very high speeds without any possibility of damage to the two originals as may occur if a recirculating document handling apparatus were employed. Still, there are special uses for a copier and more than likely would require the acquisition of a second copier.

The present invention couples a document scanning drum into a conventional flash exposure copier so that both types of document exposure is available. Preferably, the document scanning drum and its controls are arranged as an accessory to a copier having the conventional planar exposure platen. The drum assembly may be placed on top of the exposure platen when the need for a scanning drum occurs. The present invention is directed to an optical arrangement which will permit the two types of exposure for this dual mode of operation when the accessory is to be used.

Therefore, the principle object of the present invention is to permit use of document scanning drums in copiers employing other modes of document exposure and particularly those utilizing very high speed copy processing steps.

This and other objects are attained by an optical arrangement which includes a document scanning system for exposing a document and producing a flowing latent image on a photoreceptor xerographic belt in a belt type copier. The drum is detachably mounted on the exposure platen for the copier and the optical system for drum scanning and imaging form part of the optical system for the copier. Mirror means is provided in the optical system for drum scanning and is actuable into the optical path therefor when the scanning mode has been selected and is movable out of the path when conventional imaging has been selected for the copier.

The present application is related to the companion applications filed on even date herewith and commonly assigned: U.S. patent application Ser. No. 590,248 entitled "Document Scanning Drum and Flash Exposure Copier"; U.S. patent application Ser. No. 590,297 entitled "Document Scanning Drum and Flash Exposure Copier"; U.S. patent application Ser. No. 590,245 entiled "Sheet Registration in Copier for Multiple Sizes of Sheets"; U.S. patent application Ser. No. 590,131 entitled "Copier Employing Document Scanning and Flash Exposure".

This and other objects and advantages will become apparent after reading the accompanying description taken in conjunction with the accompanying drawings wherein.

Figure 6A:
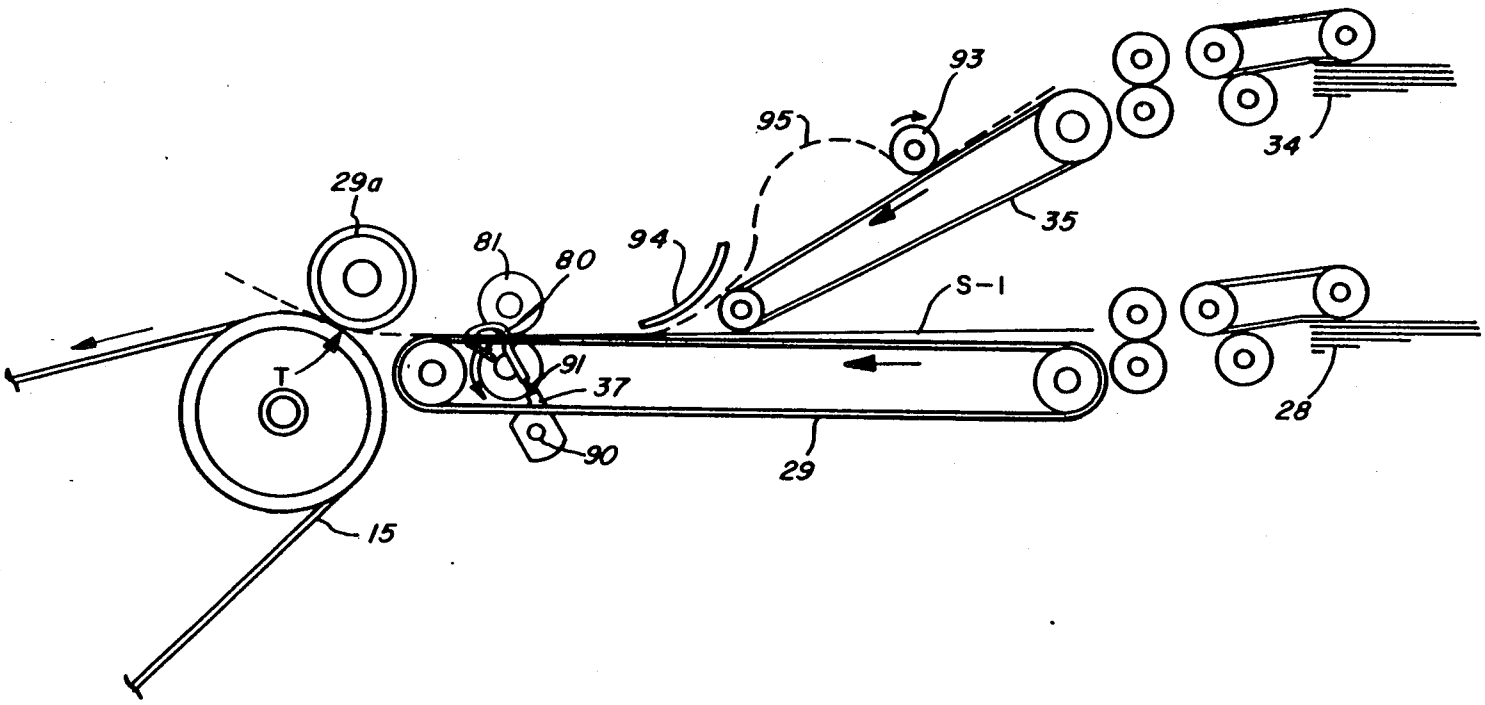
Figure 6B:
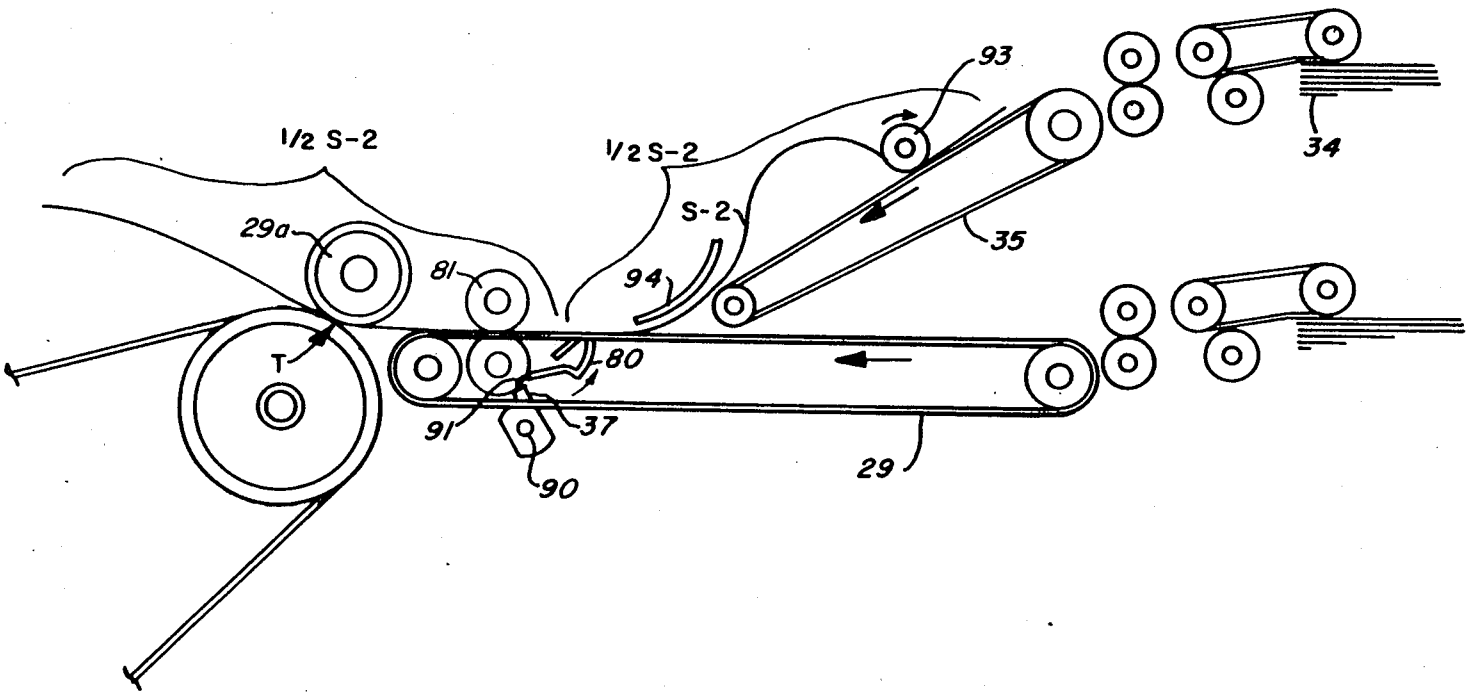
Figure 7:
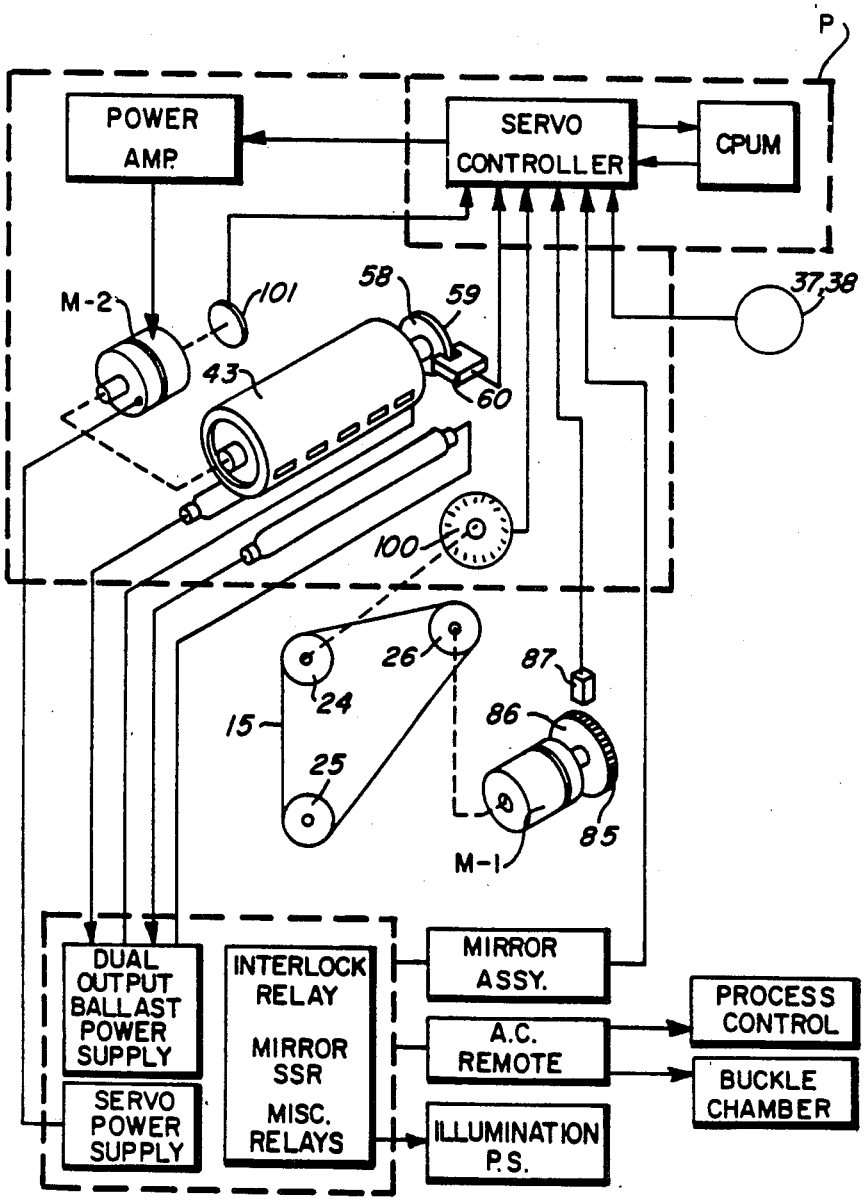

FIGS. 6*a* and 6*b* are schematic illustrations of a portion of the paper path in two different modes of operation; and FIG. 7 is an electrical block diagram of the control system in accordance with the present invention.

Figure 1:
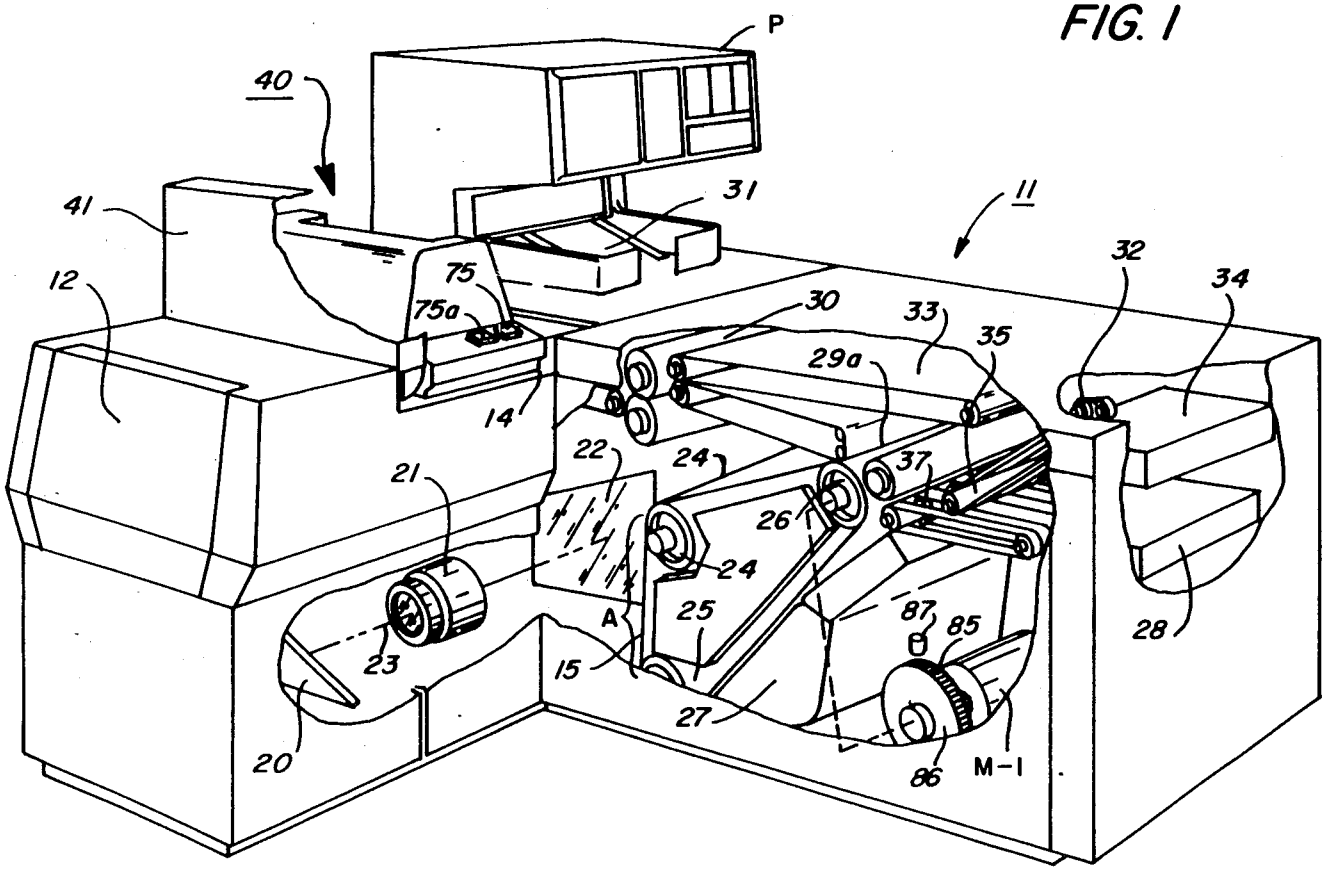
FIG. 1 is a perspective view of a duplicating system incorporating an automatic document handling apparatus, a document supporting drum assembly and a copy sheet processor, to which the present invention is applied.

For a general understanding of an automatic electrostatographic duplicating machine to which the present invention may be incorporated, reference is made to FIG. 1 wherein components of a typical belt-type electrostatographic printing machine are illustrated. The printing system is preferably of the xerographic type as one including a xerographic processor 11, and a document handling apparatus 12. Preferably, the printing system 11 and 12 is the commercial, highly sophisticated embodiment of the Xerox Duplicator model 9500® which utilizes flash, full frame exposure, for very high speed production. Originals or document sheet handling and exposure, image processing and copy sheet transport/handling are under control by a machine programmer and are effected in timed sequence in conjunction with the machine clock system, and in accordance with the program an operator has preset in the machine. Further details in this regard are not necessary since the Xerox 9500® Duplicator operates in this manner and is well known. Details of the timing relationships and devices, the programmer, and related structure and events are described in U.S. Pat. Nos. 3,790,270; 3,796,486; and 3,917,396, commonly assigned and which are incorporated by reference.

In the illustrated xerographic system, a light image of a document sheet, or an original to be reproduced, is projected onto the sensitized surface of a xerographic photosensitive surface to form an electrostatic latent image thereon. Thereafter, the latent image is developed with toner material to form a xerographic powder image corresponding to the latent image on the photosensitive surface. The powder image is then electrostatically transferred to a record material such as a sheet or web of paper or the like to which it may be fused by a fusing device whereby the powder image is caused to adhere permanently to the surface of the record material.

The xerographic processor 11 is arranged as a self-contained unit having all of its processing stations located in a unitary enclosure or cabinet. The processor includes an exposure station at which an original or document sheet to be reproduced is positioned on a glass platen 14 for projection onto a photosensitive surface in the form of a xerographic belt 15. The document sheet or set of individual document sheets is selectively transported by the document feed apparatus 12 including a transport belt from the beginning of the set of sequenced document sheets in the apparatus to the platen for exposure and then returned on completion of the exposure until the entire stack has been copied, at which time the document set handling cycle may be repeated indefinitely as described in U.S. Pat. No. 4,412,740 entitled "Automatic Document Handler" and commonly assigned with the present invention.

Imaging light rays from a document sheet which is flash illuminated by suitable lamps are projected by first mirror 20 and a projection lens 21 and another mirror 22 onto the xerographic belt 15 at the focal plane for the lens 21 along a path indicated by dotted lines 23.

The xerographic belt 15 is mounted for movement around three parallel arranged rollers 24, 25, and 26 suitably mounted in the frame of processor 11. The belt is continuously driven by an a.c. induction motor M-1 and at a speed indicative of the process speed for the processor 11. The exposure of the belt to the imaging light rays from a document sheet discharges the photoconductive layer in the area struck by light whereby there remains on the belt an electrostatic image corresponding to the light image projected from the document sheet. As the belt continues its movement, the electrostatic latent image passes a developing station at which there is positioned a developer apparatus 27 for developing the electrostatic latent image.

After development, the powdered image is moved to an image transfer station T whereat record material or copy sheets of paper just previously separated from a stack of sheets in a main sheet feeder 28 and transported by a multiple belt transport 29 to the transfer station is held against the surface of the belt by a transfer roller **29*a* to receive the developed powder image therefrom. The copy sheet is moved in synchronism with the movement of the belt during transfer of the developed image. After transfer, the copy sheet is conveyed to a fusing station where a fuser device 30 is positioned to receive the copy sheet for fusing the powder thereon. After fusing, the copy sheet is transported selectively to a catch tray 31**, a suitable sorter, or finisher (not shown) or the like, or alternatively, transported back into the processor for duplexing, if so desired.

The electrostatographic reproduction system 11 and 12 is under control of a Programmer P which permits an operator various options: to turn the entire system ON or OFF; to program the reproduction system for a desired number of reproductions to be made of each original document sheet; or for a desired number of collated copy sets; to select one of many different copy reduction sizes; and to select whether simplex or duplex copies are to be made. If the duplex copying mode is selected, each sheet of copy paper bearing an image and which has passed through the fusing apparatus 30 is transported to an auxiliary sheet feeding apparatus 32 by way of a transport 33. The feeding apparatus operates relative to a sheet tray 34 which stores the one-sided copy sheets until such appropriate time as determined by the Programmer P, the apparatus 32 commences transporting the stored sheets by way of a conveyor 35 which again presents the sheets to the xerographic belt 15 for permitting the transfer of developed images thereon to the second side of the sheets. The duplex copies are again transported to the fusing apparatus whereat the second sided images are fixed.

The copy sheet transport 29 which carries sheets from the sheet supply and feeder 28 to the transfer station T is driven by the motor M-1 by way of a belt (not shown). The transport also includes rotatable registration fingers 37 between the belts of the transport for registering each copy sheet for each rotation of the fingers thereby insuring the proper registration of each copy sheet relative to a developed image on the belt 15. Rotation of the fingers 37 may be imparted by a driving connection to the drive motor M-1 and system therefor for the belt 15 for synchronous action therebetween. Such a sheet registration/timing system is utilized in the above referred to Xerox Duplicator 9500® and is described in detail in U.S. Pat. No. 3,790,271, the description of which is hereby incorporated by reference. The rotation of the fingers 37 is associated with a sensing device 38 (see FIG. 7) adapted to generate a pulse once for each system cycle or pitch which corresponds to one complete rotation of the fingers when in registration position, which corresponds to the dimension of a standard size copy sheet in the direction of movement plus the distance equal to one spacing between copy sheets.

Further details of the processing devices and stations in the printer system are not necessary to understand the principles of the present invention. However, a detailed description of these processing stations and components along with the other structures of the machine are disclosed in U.S. Pat. No. 4,054,380 which is commonly assigned with the present invention and which is incorporated by reference herein.

The present invention contemplates the use of a document supporting and scanning drum assembly generally indicated by the reference numeral 40 which is adapted to be manually positioned upon the platen 14 and precisely located and secured to the machine frame by any suitable securing devices. In order to accommodate the assembly 40, the platen cover 41 for the machine 11 and 12 is manually pivoted upwardly to provide operator access to the machine platen. In the present arrangement, the machine is adapted for dual operation, that is, the machine may be used in the conventional manner by making copies using: (1) the platen 14 for supporting document sheets placed thereon by either an automatic feeding document handling apparatus 12 or manually, and utilizing the flash, full frame exposure feature of the machine, or (2) a document scanning drum upon which one or two documents are mounted, and image exposure is effected by a scanning technique to produce a flowing image on the belt 15. As will be described in more detail hereinafter, drive means and control therefor produce controlled rotation of the drum whereby the flowing exposing image upon the photosensitive belt 15 is formed.

Figure 3:
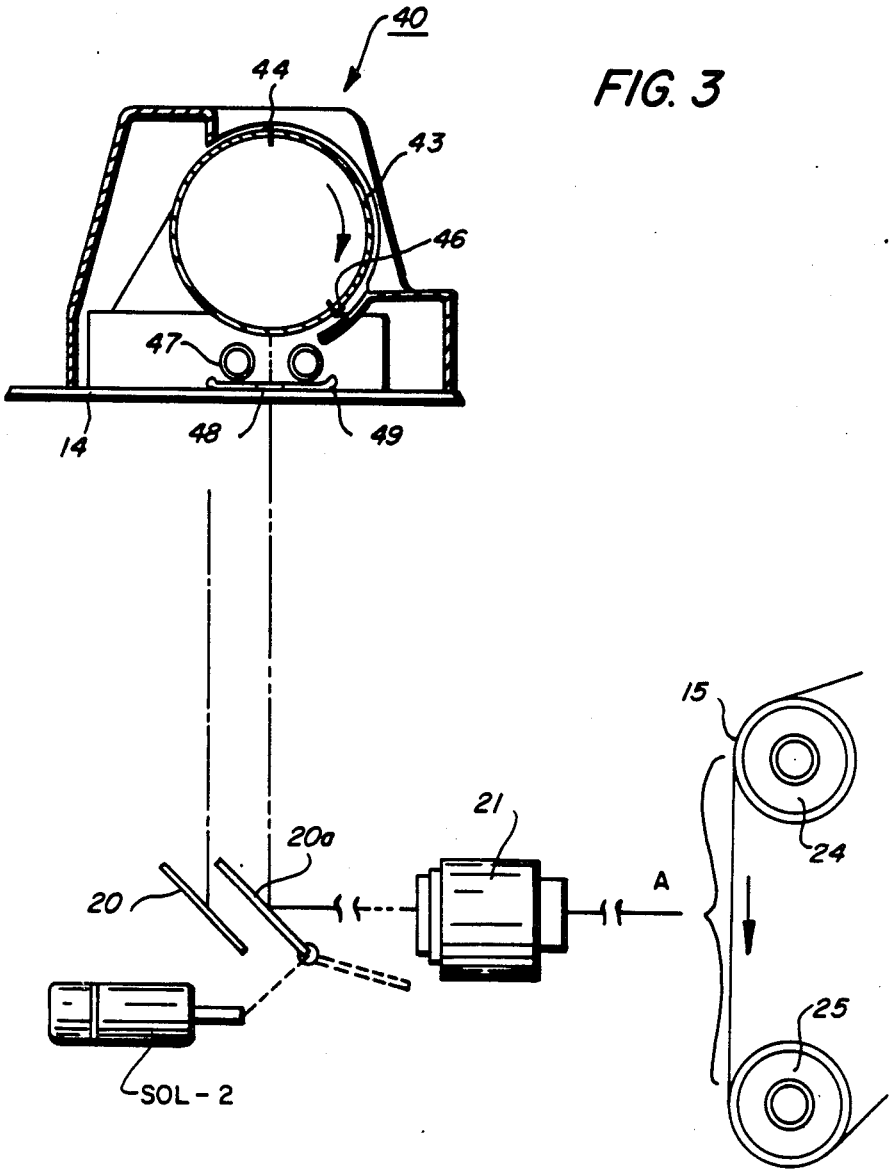
FIG. 3 is a schematic illustration of the optical path between a document scanning drum whereat a document sheet is scanned and a constantly moving photoreceptor belt being arranged in accordance with the present invention.
Figure 4:
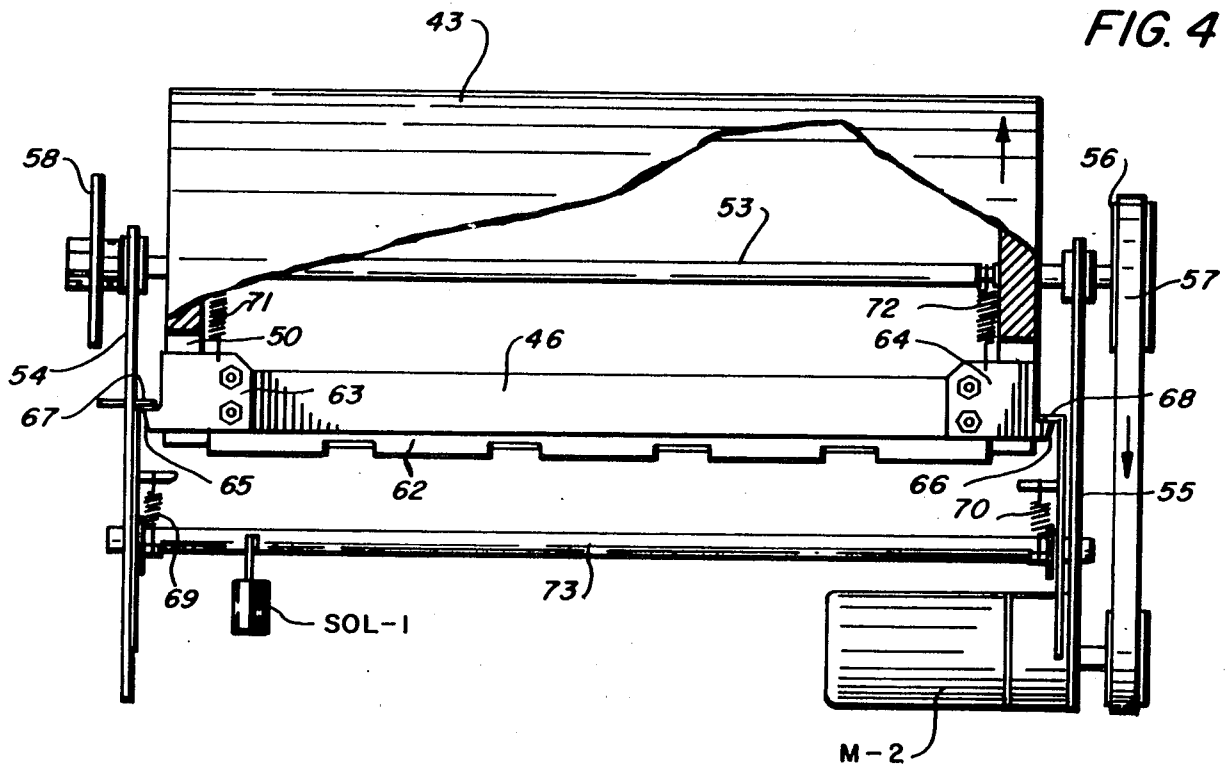
FIG. 4 is a partial cross-section of the document scanning drum.

As shown in FIGS. 3 and 4, the document drum assembly 40 includes a document drum 43 having first and second sheet edge-gripping members 44 and 46 extending axially along the drum and suitably mounted thereon for selectably gripping an edge of a large document sheet (11 inches×17 inches) by one of the members in one mode of operation, or for gripping two document sheets (8½ inches×11 inches) of approximately one half the size of the large document sheet, one by each of the members, in another mode of operation. While specific sizes have been designated herein for the size of document sheets and corresponding copy sheet sizes, it will be understood that this convention is only chosen for exemplary purposes, and that other sizes may be selected. In this convention, "regular size" refers to sheets having dimensions 8½ inches×11 inches and "large size" refers to sheets having dimensions 11 inches×17 inches as is twice the size of regular sheets. Means may be utilized which will permit an operator to apply a document sheet edge under either or both of the members 44, 46 to be held thereby during one or more rotations of the drum as the document sheet(s) is scanned. During rotation, the sheet will remain on the peripheral surface of the drum, the circumference of which is approximately equal to the dimension of the large document sheet in the direction of scanning plus a predetermined distance or spacing, or to two document sheets positioned with their short dimension in the direction of drum rotation with their adjacent edges nearly touching and their other edges separated the same predetermined distance.

With this arrangement, it is contemplated that the large document sheet having dimensions on the order of 11 inches by 17 inches with the shorter dimension edge being applied to one of the gripper members and as the sheet is applied to the drum surface will lay over the unused gripper member. In the other mode of operation, two regular size document sheets of a size 8½ inches by 11 inches may be applied to the drum using both gripper members, with the trailing edge of the first abutting the leading edge of the second sheet. Therefore, with a drum circumference of 19 inches, the spacing between the gripped edge and the trailing edge of the large document would be two inches as will be the spacing between the adjacent edges of two regular size document sheets of 8½ inches by 11 inches. In either mode of operation for each revolution of the document drum, there is a spacing of approximately two inches of the drum surface which is not involved in imaging and is utilized for a control purposed to be described below. This spacing is considered as the inactive or inter-document space since imaging of document area is not being performed.

The assembly 40 also includes a pair of elongated illumination lamps 47 arranged in parallel in close proximity to each other and the surface of the drum 43. The lamps are shielded along most of their circumference by a suitable light impervious material to prevent light from emanating therefrom other than portions of their respective surfaces adjacent the surface of the drum so that light rays from the lamps only strike the document sheet being scanned.

Imaging light rays from the document sheet are directed downwardly and through a narrow elongated scanning slit 48 formed in an aperture shield 49 and through the platen 14 to the mirror 20 for the optical system of the reproduction machine. As the drum is rotated with one or two document sheets held thereon, a flowing image of the data on the sheet(s) is formed on the photoreceptor belt 15 to produce a corresponding electrostatic latent image of the data thereon.

The path of the imaging light rays is directed to the mirror 20, through the imaging projection lens 21, the second mirror 22 and upon the belt 15 at its imaging plane located at the exposure zone A. As shown in FIG. 3, the mirror 20 is arranged in a fixed position for a first mode of imaging wherein a document sheet is positioned upon the exposure platen 14 for flash, full-frame exposure. Since the optical conjugate between a document sheet being exposed and the image plane of the photoreceptor belt is held constant, a second mirror **20*a* is arranged to be positioned closer to the lens 21 a distance equal to the space between the upper surface of the platen 14 and the document sheet applied to the surface of the drum 43. The mirror 20*a* is utilized when the drum 43 is being utilized for scanning documents thereon during the second mode of imaging wherein a flowing image is presented to the exposure zone A. The mirror 20*a* is pivotally mounted to the machine frame and a solenoid SOL-2 is utilized to swing the mirror downwardly to the dotted position when the mirror 20*a* is not in operation when full frame flash exposure of document sheets on the platen 14** is being utilized.

Figure 5:
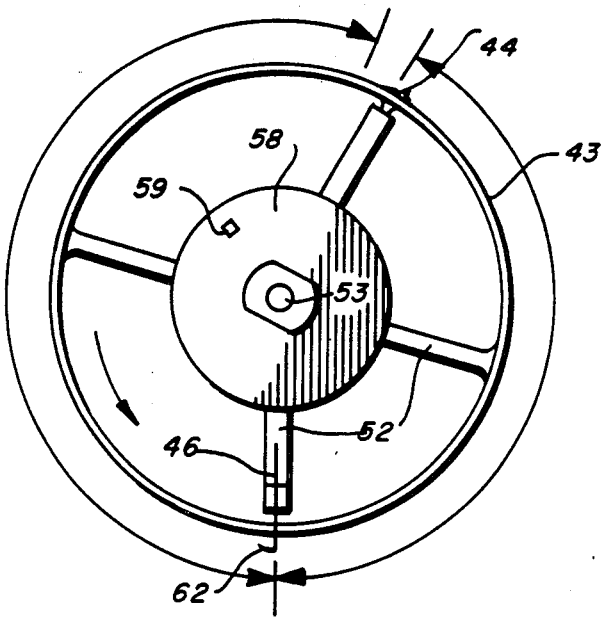
FIG. 5 is an end view of the scanning drum.

The drum assembly 40, as shown in FIGS. 4 and 5, comprises end support frames 50, 51, each having radial legs 52 for supporting a shaft 53. The shaft 53 supports the drum 43 for rotation upon support brackets 54, 55. A pulley 56 secured to one end of the shaft is connected by a timing belt 57 to a d.c. servo motor M-2. At the other end of the shaft 53, exterior of the drum, a timing disc 58 is secured and is formed with a small arcuate slot 59 arranged to cooperate with an LED/detector unit 60 having a purpose to be described below.

As shown in FIG. 4, the gripper member 46 is identical to member 44, with both being formed with a plurality of fingers 62 which actually engage and hold down the edge of a document sheet. Each member 44, 46 has end brackets 63, 64 which are adapted to slide radially within slots formed in corresponding legs 52 of the end frames 50, 51. The brackets 63, 64 are formed with outwardly extensions 65, 66 respectively, each of which is arranged to contact radially slideable actuators 67, 68. The actuators 67, 68 are held in contact with the extensions 65, 66 by light springs 69, 70 connected between pins on the elements and a suitable anchor. The fingers 62 are normally held in contact with the adjacent surface of the drum 43 by relatively heavy springs 71, 72. Actuation of the fingers 62 outwardly to accept a document sheet is accomplished by a solenoid SOL-1 having its plunger connected to a rod 73 arranged parallel to the shaft 53 and having its ends connected to the actuators 67, 68. Upon energization from a signal from the machine logic, the solenoid actuates the rod 73 outwardly away from the shaft 53 and against the force of the springs 71, 72. This movement of the actuators 67, 68 is imparted to the extensions 65, 66 which drives the gripper member 46 radially outwardly, as shown in FIG. 4 to move the fingers 62 away from the adjacent surface of the drum and to permit the operator sliding an edge of a document sheet between the fingers and the surface of the drum 43.

Loading of a document upon the drum 43 is accomplished when either of the gripper members 44 or 46 is in its lowermost position, as shown in FIG. 5 for the member 46. In this position, the extensions 67, 68 will be aligned with the brackets 63, 64 for the particular gripper member. The operator need only slide a document sheet under the drum 43 from left to right as viewed in FIG. 5 when the fingers 62 have been lowered slightly away from the drum surface.

Energization of the solenoid SOL-1 to permit loading of a document sheet may be achieved by a suitable control switch button 75 on the console for the drum assembly. The circuit for the button 75 and the solenoid includes momentary actuation of the motor M-2 for incremental rotation of the drum 43 to position selectively each of the gripper members 44, 46 to the six o'clock position for operator use. In the event a single, large size document is to be loaded on the drum, a double actuation of the switch button 75 is performed whereas for loading two regular size documents, a single actuation for each document will serve to fully load the drum with two documents. Another button 75a on the console serves to provide electrical power to the mirror solenoid SOL-2 to condition the optical system of FIG. 3 for use of the mirror 20a. Actuation of the button 75a will pivot the mirror into the exposure optical path.

With the capability for supporting two regular size document sheets or one large size sheet for imaging purposes by the scanning technique, the processor 11 is arranged for supplying and processing equivalent sized copy sheets, and if a 1:1 magnification has been chosen at the console for the Programmer P. In other words, the processor 11 and document drum assembly 40 provides the capability of producing size-for-size copies of two different size document sheets, particularly where the size ratio is 2:1. For a copier processor normally adapted for a supply of regular size copy sheets, the ability to select another size of copy sheets wherein the extra size may be twice as long and is in the direction of sheet travel, problems may arise rendering such ability impossible. This prospect is particularly the case in processors employing copy sheet registration devices which factor into machine timing.

As previously stated, the host copier/duplicator as illustrated in FIG. 1 is the 9500® Duplicator marketed by Xerox Corporation. As disclosed in the U.S. Pat. No. 3,790,271, the copy sheet registration for this commercial product comprises a plurality of registration fingers which rotate and engage the leading edge of each copy sheet being fed from a copy sheet supply tray and directed to a image transfer station. The copy sheets are fed to the registration fingers at a relatively high speed, say on the order of 30 inches per second by the transport 29, and upon engaging the fingers are slowed down to a speed approximately 20 inches per second which is the process speed for the processor which may be approximately 20 inches per second. As the fingers are rotated in the direction of sheet movement, they move away from the leading edge of the sheet at precisely the time the leading edge is picked up by a pair of pinch rollers for further movement into the processing stations of the copier. This pick up by the pinch rollers may be utilized as the reset point for the machine clock for the copier which serves to control the timing of the processing events therein. The time between the leading edges of copy sheets as they are picked up by the pinch rollers is the cycle time or pitch for the copier and generally equals the dimension of the copy sheet in the direction of travel plus one spacing between sheets.

As shown in FIG. 6a, the main sheet supply tray 28 is arranged to supply copy sheets to the transfer station T by way of the transport 29 which comprises a plurality of spaced belts. As each sheet is so transported, the leading edge thereof engages the registration fingers 37 which rotate through the plane of the belts of the transport in a direction away from the direction of movement of the sheet as shown by the arrow. The speed of rotation of the fingers is such that upon each revolution as the sheet engaging surface 80 on each of the fingers traverses the plane of the transport belt of the transport 29, they engage the leading edge of a sheet which is moving at a faster velocity. The sheet is thereby slowed to the linear speed which the registration fingers produce by virtue of the shape of the surfaces 80 as the same travel in an arc between the two points whereat the sheet engaging surface traverses the plane of sheet travel and which defines the registration zone for copy sheets.

When the sheet engaging surface 80 is rotated downwardly away from the plane of sheet travel, the sheet velocity is at the predetermined, desired speed equal to the image processing speed, that is, the speed of the photoreceptor belt 15. As the leading edge of the sheet is disengaged from the surface 80, it is at the nip of pinch rollers 81 which transports the sheet into the transfer station T at the process speed.

Programming control for the machine processing steps is accomplished in conjunction with pitch reset wherein after a number of electrical pulses are generated corresponding to the movement of each copy sheet plus one spacing through the transfer station, reset of this number, or pitch, is accomplished when the photoreceptor belt has travelled a precise, predetermined distance, as related to the movement of a copy sheet plus one spacing. Pulse generation for a timing control signal, as previously stated, is accomplished by utilizing a connection of the photoreceptor belt 15 to a pulse generating device so as to move at all times directly therewith as described above and reset is accomplished by a reset mechanism which is reset at a predetermined position of the leading edge of each sheet of paper in proper registration to a developed image on the photoreceptor belt. With the belt continuously moving and being driven by a drive directly connected to the processing programming control, each pitch reset occurs precisely at predetermined distances of movement of the belt.

The programming control is acquired by means of a timing or clock device mechanically coupled to the shaft for a drive means M-1 which drives the roller 26 and thereby imparts processing motion to the photoreceptor belt 15. A pulse generating device is arranged to produce a continuous train of time pulses in accordance with the rotational speed of the drive means M-1 and includes a predetermined number of teeth 85 on the gear 86 with each of the teeth being sensed by a sensor 87 to produce a pulse thereby. As previously stated, details and operation of the pulse generating device and its incorporation into the processor 11 is disclosed in U.S. Pat. Nos. 3,790,271 and 4,054,380 which are incorporated by reference herein.

The train of pulses produced by the sensor 87 of the pulse generating device is electrically connected to a counting device (not shown) which may be in the form of a shift register mechanism which counts the pulses of the control signal. After a number of pulse have been counted, the count is restarted or set to zero which is described herein as the pitch reset. Rather than having a predetermined number of pulses cause the reset, it is preferred to utilize the width of a regular size sheet of paper plus one spacing or the distance of movement of the belt 15 as being indicative of the reset causing standard. This is accomplished, as previously stated, by rotation of the sheet registration fingers 37. Any machine event or processing step in the processor 11, the document handling apparatus 12, and the document drum assembly 40 can be initiated, directly or indirectly, or be related therewith or to remain operative for any period of time in accordance with one or more of the discrete pulses. Pitch reset is accomplished during sheet registration, after each revolution of the registration fingers 37 which are arranged to be periodically interposed in the path of movement of sheets of paper just immediately prior to the insertion of each sheet into the nip of the transfer roller 29a and the belt 15 at station T.

Figure 2:
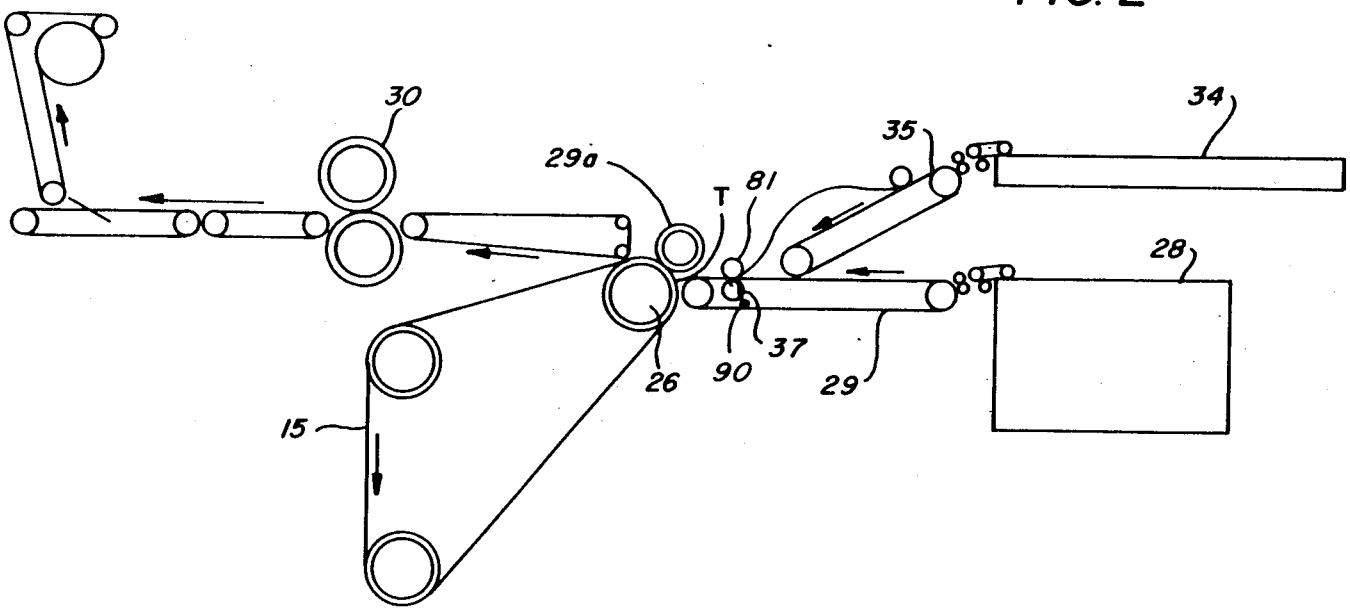
FIG. 2 is a schematic illustration of the paper path for the system of FIG. 1.

As shown in FIGS. 2, 6a, and 7 sheet registration is accomplished by means of the plurality of the spaced registration fingers 37 rotatably mounted on a shaft 90 in alignment transversely of the paper sheet path. The shaft is suitably supported for rotation on the machine frame and is operatively connected by way of a variable speed device (not shown) which in turn is operatively connected to the drive means M-1 to be driven at a speed coordinated with the speed of the belt 15 and the copy sheet transport 29. For each complete rotation of the fingers 37 in the direction of the arrow, and when they attain the position shown in FIG. 6a, a sheet $S_1$ is in engagement with the fingers to become straightened in its traveling and to become positioned and timed, in other words, registered. The distance between the fingers when a sheet is registered and the nip at the transfer station T is arranged to be very small and precisely known. The instant the fingers become disengaged from each sheet, the sheets will be in the nip of the pair of the driven registration pinch rollers 80 and these two occurrences are utilized as the pitch reset event. The pulse occurring at that time by the pulse generating device or counting mechanism 85, 86, 87, is given the designation as the zero pulse or pitch reset. All other pulses are counted from that event, until the next registration for the next sheet and the corresponding zero pulse or pitch reset. As disclosed in the above cited U.S. Pat. No. 4,054,380, the pulse generation and reset function for the machine so far described serves to initiate and control the events for complete machine processing.

For typical speed relationships for sheet feeding, registration and machine processing, the mechanism so far described is adapted as follows. Assuming the machine processing speed is 20 inches per second, that is, each sheet must be introduced to the transfer nip T at this speed and all other processing stations are functioning approximately at this speed, it is desirable that the sheet supply speed be greater in order to insure time for proper registration and to speed up total machine operation. Greater sheet supply speed also minimizes the effect of inefficiencies or mis-timing in the sheet supplying devices 28, 34. Preferably, the sheet supply feed is approximately 30 inches per second. Under these circumstances, the fingers 37 must slow each sheet from speeds of 30 inches per second to a speed of 20 inches per second. In accomplishing these actions, the fingers are at an effective speed such that the sheet travels at 20 inches per second at the instant when sheet registration occurs. After this occurs, faster increases in finger rotative speed are imparted to the fingers so that they may be moved out of interferring relationship with copy sheets being transported over the registration zone.

The foregoing description of the copy sheet registration arrangement and the operation thereof, which is also disclosed in the above cited U.S. Pat. No. 3,790,271, pertains to the processing of copy sheets of standard size, namely 8½ inches by 11 inches with the edges having the long dimension of 11 inches being the leading and trailing edges during the sheet movement. Since the shorter dimension is in the direction of movement, the pitch (sheet dimension in the direction of travel plus one spacing between sheets) represent approximately 10 inches. This convention provides then for about an inch and one half spacing and thereby allows some small variation in sheet size, say for example, between the use of the so called A5 and A4 paper sizes.

In the present registration arrangement, the registration fingers are constructed either as being flexible or having a flexible support portion which are sufficiently flexible as to flex out of registration positions and yet permit continued rotation of the supporting shaft 90 in the event a sheet of paper is in the registration zone. As shown in FIG. 6b, a large sheet of copy paper (having a size 11 inches × 17 inches), indicated as $S_2$ is positioned to span the distance from the transfer nip, past the pinch rollers 81, across the registration zone and upon the transport 35. With the sheet $S_2$ so positioned, the fingers 37 are shown in their flexed condition below the sheet, have been caused to flex by the contact thereof with the still moving sheet in the registration zone.

In the illustrated arrangement, the fingers 37 are flexed at a flexture joint 91 about midway along their length. Preferably the fingers are made of metal but include a section thereof made of spring material. It will be understood that any other flexible arrangement may be utilized, such for example, the use of a pivotal mounting of the fingers relative to their supporting shaft 90. In any event, the fingers should have sufficient strength or be devised so as to provide sufficient counter force against the force imposed thereon by sheets of paper being registered thereagainst.

With the fingers 37 being made flexible upon contact with the underside of a sheet of copy paper, the sheet transport 35 with some modifications, the sheet transport 29, the registration devices 37 and 81 are adapted not only to transport and register standard size sheets of copy paper, but also sheets which are much larger, for example, sheets which are double the standard size, that is, 11 inches by 17 inches. As shown in FIG. 7b, the designation $S_2$ represents a sheet that is 11 inches by 17 inches with the long dimension thereof being in the direction of sheet travel.

In utilizing the large 11 inch by 17 inch copy sheets, the registration fingers 37, by being flexible, serve to register these sheets in the conventional manner on every other machine cycle or pitch. During those cycles when registration is not to occur, that is, when the sheets, because of the extra longer length are still in the registration zone, the fingers merely flex out of operative position as they contact the underside of the sheet while continuing to rotate. It will be apparent that during the non-registration cycles and since sheet $S_2$ is twice the length of sheet $S_1$, the portion of the fingers 37 which contact the sheet $S_2$ do so at approximately the midpoint thereof during their travel.

In order to handle the extra large 11 by 17 inch sheets, the transport 35 is modified to include a roller 93 which is arranged for slipping contacting with the belts for the transport by being driven at a slightly higher speed, and a curved guide plate 94 mounted to guide the extra large sheets onto the transport 29. The distance between the roller 93 in contact with the transport 35 and the registration fingers 37 as they are about to rotate out of contact with the leading edge of sheet $S_2$ at the nip of the rollers 80 is longer than the standard size sheet S, and shorter than the larger sheet $S_2$. This arrangement produces a buckle 95 on the sheet $S_2$ as the same is registered thereby insuring that the trailing edge of the sheet clears the sheet feed pinch rollers 96 for the auxiliary sheet feeder 34.

The provision of the roller 93 at higher speeds and the guide 94 permits the auxiliary sheet feeder 34 to accommodate both standard size sheets S, and sheets $S_2$ of double this size. When using standard size sheets in the feeder 34, the roller 93 has no effect on these sheets since as the sheets are being registered, they will be out of operative contact with the roller 93.

The controlling Programmer P and the machine logic therefor for the duplicator system 11 and 12 is suitably modified to a slight degree to incorporate the use of the extra large sheets $S_2$. Such modifications would involve merely inhibiting certain process steps which normally occur repetively as the fingers 37 register a sheet and the ensuing pulse generating after reset normally conditions the machine for standard size sheet operation.

In the control circuit schematic of FIG. 7, the photoreceptor belt 15 and its supporting rollers 24, 25, 26 are shown integrated for cooperating control with the document drum 43 by the machine Programmer P. The idler supporting roller 24 for belt 15 has servo encoder 100 connected to its shaft, which upon normal rotation during copy sheet processing, is adapted to produce approximately 350 pulses per rotation. A similar servo encoder 101 is connected to the shaft for the document drum servo motor M-2 and is adapted to produce the same pulses at the same rate.

Each of the encoders 100, 101 are electrically connected to a servo controller 102 where their frequencies are compared. With the encoders being indicative of the velocities of their respective supporting shafts, the velocities are compared in the controller 102. In the event the velocity of the drum surface for the drum 43 is not equal to the velocity of the belt 15, a corrective signal is generated in the controller and supplied to the servo motor M-2 to adjust the velocity of the drum to match the velocity of the photoreceptor belt 15. This corrective action may involve either speeding up or slowing down the drum surface velocity with the resultant effect of maintaining synchronous movement of the surface of the belt 15 and the surface of a document sheet being scanned on the drum 43. In this manner, at all times during document scan and imaging on the photoreceptor belt, degradation of image quality due to fluctuating relative surface motion is eliminated or greatly minimized.

The control circuit arrangement presented in FIG. 7 also insures that the document drum 43 and the photoreceptor belt 15 have a positional relationship during a reproduction run regardless of whether the document drum is supporting two document sheets of regular size (8½ inches×11 inches) or a single document sheet of the large size (11 inches×17 inches). To maintain correct positional reference between the document drum and the belt 15 for the xerographic processor 11, the control system in the Programmer P, in conjunction with the servo controller 102, measures the position of the document drum and the position of the belt 15 and calculates a position error signal. The position of the document drum is measured from the cycle pulse established with the slot 59 formed in the timing disc 58 (see FIG. 5) and a LED/detector 60 device arranged on the drum mounting to sense the position of the slot 59 (see FIG. 7). The position of the belt 15 is measured from the periodic rotation of the registration fingers 37 relative to the sensing device 38 during each resetting of the pulse count of the pulse generating device 85, 86, 87 for each sheet of regular size being registered, or for one large sheet every other pitch or cycle.

In measuring the positional relationship of the drum 43 and the photoreceptor belt 15, the slot 59 serves as a home position reference for the loading of documents on both of the gripper members 44 and 46 when regular size document sheets are being copied or a single large size document sheet is being loaded on the member 44. The home position reference is established at the leading edge of the document sheet held by the gripper 44 and may comprise the signal generated by the LED/detector device 60, when intercepted by the slot 59, plus a few predetermined number pulses from the encoder 101 for the document drum servo motor M-2. In this manner, the very accurate timing of a home signal may be established for producing the aforesaid positional relationship, which in turn, also becomes very accurate.

During the inactive image area of the document drum, that is, within the area on the drum surface not supporting a document sheet, the position error signal is arranged to energize the drum servo motor M-2 through a short speed change cycle to create a positional change between the document drum and the photoreceptor belt. In this manner, from the foregoing, the control circuitry maintains both position sync and velocity sync between the document drum 43 and the xerographic processor 11.

Most significant in this arrangement is that the document drum is adapted to be indexed to two different positions for document loading and permit the scanning of two document sheets of regular size with the consequent production of two corresponding copy sheets or for the production of one large copy sheet corresponding to these two document sheets for each revolution of the drum, or for the scanning of one large document sheet and the corresponding production of one large copy sheet. In each of the scanning and production operations, copies are produced on a size-to-size basis, that is, there is no enlargement or reduction in the size of copied information being transferred to copy sheets.

While the invention has been described with reference to the structure disclosed, it is not confined to the details set forth, but is intended to cover such modifications or changes as may come within the scope of the following claims.

We claim:

1. In an electrostatographic printing system having an electrostatographic processor with processing stations and an exposure platen upon which a document sheet is placed to be copied and having a movable photoreceptor member in belt form and drive means for moving the photoreceptor member along a path through said processing stations, and lens means for imaging a document on said platen through an optical conjugate path onto said photoreceptor member; the improvemen comprising:

a document scanning assembly, including a rotatable drum and an imaging station with slit illumination means and an imaging slit, said document scanning assembly being removably mountable directly onto said platen, said drum being spaced above said platen and adapted to repeatedly rotate one or two documents over said platen held on said rotatable drum for imaging through said platen through said imaging slit with said slit illumination means to make multiple copies of said documents in said electrostatographic processor;

said document scanning assembly including servo drive means for rotating said rotatable drum in synchronism with said movable photoreceptor member;

first imaging means, including a movable mirror inserted into said optical path, for only imaging documents held on said rotatable drum through said imaging slit and through said platen, for scanning said documents held on said rotatable drum and directing the partial, flowing, slit scanned images therefrom to said photoreceptor member through said lens means;

second imaging means for producing flash exposure of all of the area of a document sheet on said platen at once through said platen and directing the full image therefrom to an area of said photoreceptor member through said same lens means;

said second imaging means including a fixed mirror in said optical path between said platen and said lens means and not including said movable mirror;

said movable mirror for said first imaging means being inserted into said optical path between said fixed mirror and said lens means in a position closer to said lens means than said fixed mirror, which maintains an equal optical conjugate path for said first imaging means as for said second imaging means;

and means for selectively actuating said first and second imaging means being said movement of said movable mirror into and out of said optical path.

* * * * *